US008714071B2

(12) United States Patent
Foley et al.

(10) Patent No.: US 8,714,071 B2
(45) Date of Patent: May 6, 2014

(54) OVERPRESSURE PROTECTION

(75) Inventors: Peter Maurice Foley, Castle Rock, CO (US); Thomas Christopher Manney, Bennett, CO (US)

(73) Assignee: Skydex Technologies, Inc., Centennial, CO (US)

( * ) Notice: Subject to any disclaimer, the term of this patent is extended or adjusted under 35 U.S.C. 154(b) by 0 days.

(21) Appl. No.: 13/113,864

(22) Filed: May 23, 2011

(65) Prior Publication Data

US 2011/0283876 A1 Nov. 24, 2011

Related U.S. Application Data

(60) Provisional application No. 61/347,305, filed on May 21, 2010.

(51) Int. Cl.
*F41H 5/02* (2006.01)

(52) U.S. Cl.
USPC ..... 89/36.01; 89/36.02

(58) Field of Classification Search
USPC ..... 89/36.01, 36.04, 939, 918, 36.02; 102/303; 5/653, 655.7; 297/219.1
See application file for complete search history.

(56) References Cited

U.S. PATENT DOCUMENTS

| | | | | |
|---|---|---|---|---|
| 4,495,237 | A | 1/1985 | Patterson | |
| 5,030,501 | A | 7/1991 | Colvin et al. | |
| 5,390,580 | A | 2/1995 | Gibbons, Jr. et al. | |
| 5,470,641 | A | 11/1995 | Shuert | |
| 5,572,804 | A | 11/1996 | Skaja et al. | |
| 5,596,781 | A | 1/1997 | Graebe | |
| 5,617,595 | A | 4/1997 | Landi | |
| 5,638,565 | A * | 6/1997 | Pekar | 5/710 |
| 5,701,621 | A | 12/1997 | Landi et al. | |
| 5,976,451 | A | 11/1999 | Skaja et al. | |
| 6,029,962 | A * | 2/2000 | Shorten et al. | 267/145 |

(Continued)

FOREIGN PATENT DOCUMENTS

| | | | |
|---|---|---|---|
| JP | 07-243796 | A | 9/1995 |
| JP | 06-194490 | A | 7/2006 |

(Continued)

OTHER PUBLICATIONS

International Searching Authority, International Search Report, PCT/US2011/037586, dated Feb. 9, 2012, 5 pages.

(Continued)

*Primary Examiner* — Samir Abdosh
*Assistant Examiner* — John D Cooper
(74) *Attorney, Agent, or Firm* — HolzerIPLaw, PC

(57) ABSTRACT

Overpressure absorbing material is positioned on the exterior of an enclosure. When an explosion occurs adjacent the enclosure, the overpressure absorbing material absorbs a large portion of an incoming overpressure wave from the explosion. The overpressure absorbing material cushions the impact of the overpressure wave against the enclosure and may prevent the incoming overpressure wave from penetrating the enclosure in sufficient magnitude to cause injury to the enclosure's occupants. The overpressure absorbing material may also be positioned on the interior of the enclosure. The overpressure wave from the explosion may enter the enclosure via a breach or other opening and may resonate within the enclosure, causing injury to the enclosure's occupants. The interior overpressure absorbing material also prevents a significant magnitude of the overpressure wave from being reflected off the interior walls of the enclosure, resonating within the enclosure, and causing injury to the enclosure's occupants.

45 Claims, 11 Drawing Sheets

(56) References Cited

U.S. PATENT DOCUMENTS

| | | | | |
|---|---|---|---|---|
| 6,098,313 | A | 8/2000 | Skaja | |
| 6,174,587 | B1 | 1/2001 | Figge, Sr. | |
| 6,189,168 | B1 | 2/2001 | Graebe | |
| 6,269,504 | B1 | 8/2001 | Romano | |
| 6,386,109 | B1 | 5/2002 | Brooks et al. | |
| 6,399,189 | B1 | 6/2002 | Kobayashi et al. | |
| 6,598,251 | B2 | 7/2003 | Habboub et al. | |
| 6,637,735 | B2 | 10/2003 | Monson et al. | |
| 6,713,008 | B1 | 3/2004 | Teeter | |
| 6,777,062 | B2 | 8/2004 | Skaja | |
| 6,901,617 | B2 | 6/2005 | Sprouse, II et al. | |
| 6,938,290 | B2 | 9/2005 | McKinney et al. | |
| 6,953,105 | B2 | 10/2005 | Rust et al. | |
| 7,021,017 | B2 | 4/2006 | Herron | |
| 7,033,666 | B2 | 4/2006 | Skaja | |
| 7,048,879 | B2 | 5/2006 | Kobayashi et al. | |
| 7,574,760 | B2 * | 8/2009 | Foley et al. | 5/655.7 |
| 7,591,114 | B2 | 9/2009 | Herron, III | |
| 8,069,498 | B2 | 12/2011 | Maddux et al. | |
| 2003/0110565 | A1 | 6/2003 | Grabe | |
| 2003/0205920 | A1 * | 11/2003 | Sprouse et al. | 297/219.1 |
| 2006/0277685 | A1 * | 12/2006 | Foley et al. | 5/653 |
| 2008/0282876 | A1 * | 11/2008 | Leivesley et al. | 89/36.02 |
| 2010/0176633 | A1 | 7/2010 | Brncick et al. | |

FOREIGN PATENT DOCUMENTS

| | | | |
|---|---|---|---|
| JP | 2008-284169 | A | 11/2008 |
| WO | 95-22922 | | 8/1995 |
| WO | 95-22922 | A1 | 8/1995 |
| WO | 00-33015 | A2 | 6/2000 |
| WO | 2009-075922 | A1 | 6/2009 |

OTHER PUBLICATIONS

International Searching Authority, Written Opinion, PCT/US2011/037586, dated Feb. 9, 2012, 3 pages.

International Searching Authority, International Search Report, PCT/US2011/064449, dated Jul. 24, 2012, 5 pages.

International Searching Authority, Written Opinion, PCT/US2011/064449, dated Jul. 24, 2012, 4 pages.

International Searching Authority, International Search Report and Written Opinion, PCT/US2012/041306, dated Dec. 27, 2012, 12 pages.

PCT International Search Report, US Patent and Trademark Office, PCT Application No. PCT/US2011/064449, 5 pages, Jun. 20, 2013.

* cited by examiner

OVERPRESSURE PROTECTION

CROSS-REFERENCE TO RELATED APPLICATIONS

The present application claims benefit of priority to U.S. Provisional Patent Application No. 61/347,305, entitled "Protection from Overpressure Inside a Vehicle" and filed on May 21, 2010, which is specifically incorporated by reference herein for all that it discloses or teaches.

BACKGROUND

Various vehicular or stationary enclosures are designed to protect occupants from injury due to an explosion adjacent the enclosures. Often, these enclosures incorporate armor (e.g., iron plate, rolled steel, and synthetic materials such as para-aramid synthetic fiber, Ultra-high-molecular-weight polyethylene, and various ceramics, or any combination thereof) to achieve the desired level of protection. The type and thickness of the armor is often chosen to protect occupants from an expected maximum explosion energy.

However, due to the fragile nature of the human body, even when the armor is strong enough to withstand an explosion, occupants inside an enclosure may still be injured from overpressure waves transmitted through breaches in the enclosure, open windows or doors in the enclosures and/or directly through the enclosure outer bounds (e.g., through the walls, floor, ceiling, doors, windows, etc.) against air trapped within the enclosure. Many enclosures include devices to relieve this overpressure (e.g., doors that blow off or an opening with a plug that blows out of the enclosure). However, the overpressure relief devices may not have immediate effect, especially during a critical period immediately after the explosion when the overpressure waves may echo and rebound within the confines of the enclosure. The primary and echoed waves can reinforce one another and create greater overpressure waves that can further injure the occupants of the enclosures by causing damages to soft tissues (e.g., brain concussions). Further, the overpressure waves may also cause rapid changes in the enclosure outer bounds that are in contact with the occupants, which can further injure the occupants. Injuries such as broken bones may occur by due to a rapid change in the user's position adjacent the enclosure outer bounds.

As a result, armor is often over designed to prevent any deflection and/or breach of the enclosure and prevent overpressure waves from traveling through the enclosure. However, overdesign of armor results in rapidly increasing weight and cost. As a result, present armor types and combinations are ill equipped to prevent injuries to occupants of the enclosures caused by overpressure waves and/or deflections of the enclosure within cost and weight constraints.

SUMMARY

Implementations described and claimed herein address the foregoing problems by providing an overpressure wave absorbing system with a deflectable planar layer with a matrix of deflectable protrusions extending there from having greater than fifty percent planar surface area. The deflectable planar layer with the matrix of deflectable protrusions may absorb a portion of an incoming overpressure wave and reduce a magnitude of the overpressure wave incident on a protective layer and/or reflected from the protective layer.

Other implementations described and claimed herein address the foregoing problems by placing a deflectable planar layer with a matrix of deflectable protrusions extending there from having greater than fifty percent planar surface area between a protective layer and an expected source of an incoming overpressure wave. The deflectable planar layer with the matrix of deflectable protrusions may absorb a portion of the incoming overpressure wave and reduce a magnitude of the overpressure wave incident on the protective layer and/or reflected from the protective layer.

Other implementations are also described and recited herein.

BRIEF DESCRIPTIONS OF THE DRAWINGS

DETAILED DESCRIPTIONS

Blast overpressure (BOP), also known as high energy impulse noise, is a damaging outcome of explosive detonations and firing of weapons. Exposure to BOP shock waves alone can result in injury predominantly to the hollow organ systems such as auditory, respiratory, and gastrointestinal systems. The overpressure absorbing material disclosed herein is directed at cushioning, dissipating, and/or absorbing BOP.

Figure 1:
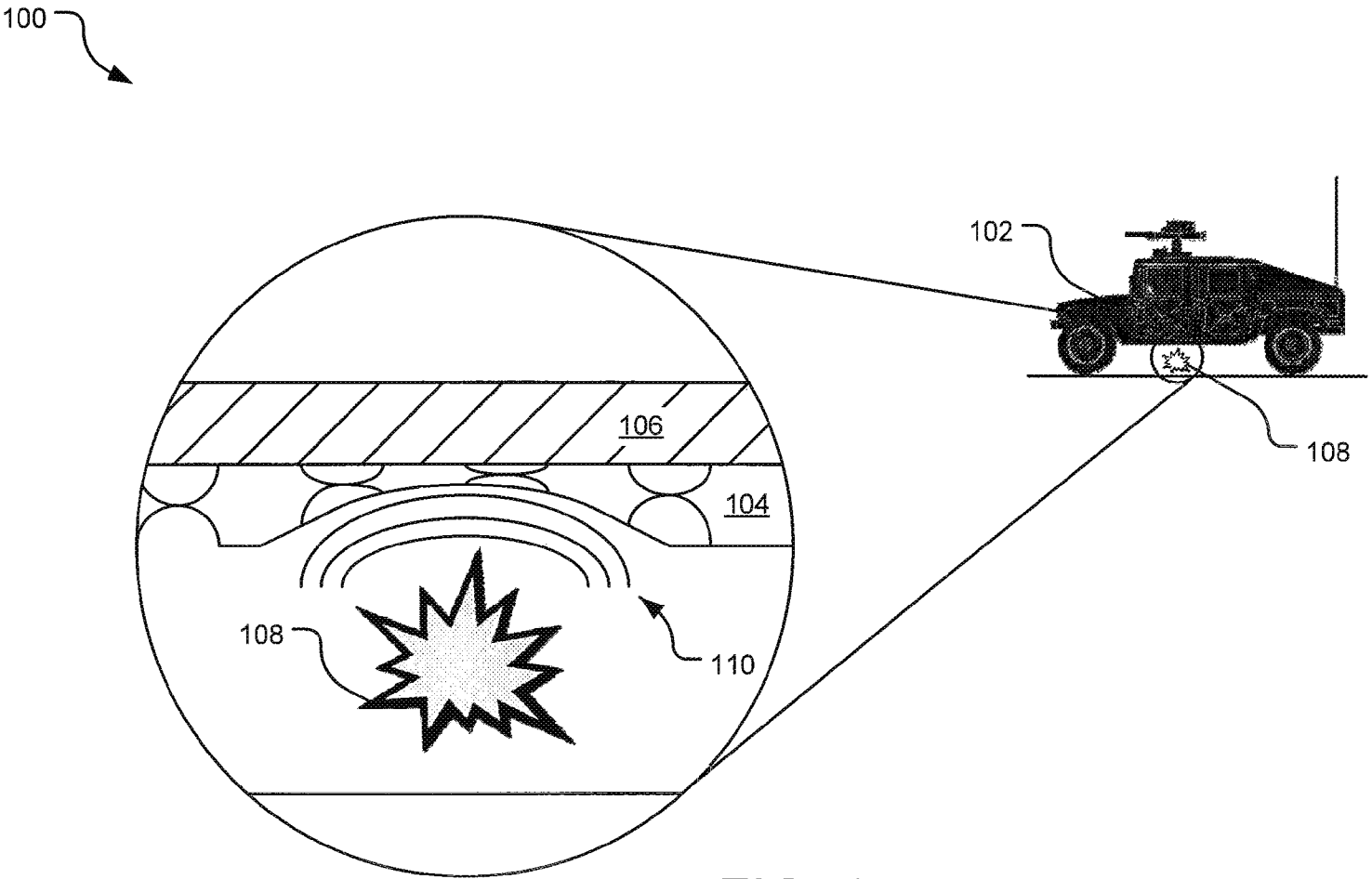
FIG. 1 illustrates an example armored vehicle equipped with exterior overpressure absorbing material.

FIG. 1 illustrates an example armored vehicle 102 equipped with exterior overpressure absorbing material (e.g., panel 104). The overpressure absorbing material is positioned on the vehicle 102 on the outside of armor 106 or other protective layer. When an explosion 108 occurs adjacent the exterior of the vehicle 102, the overpressure absorbing material absorbs a large portion of an incoming pressure wave 110 from the explosion 108. Used in conjunction with the armor 106, the overpressure absorbing material cushions the impact of the pressure wave 110 against the vehicle 102 and may prevent the incoming pressure wave 110 from penetrating the vehicle 102 in sufficient magnitude to cause injury to the vehicle's occupants by deforming, absorbing, and dispersing energy from the explosion 108. A similar combination of armor 106 and panel 104 may be used to protect occupants within a stationary enclosure that is at risk of adjacent exterior explosions (see e.g., FIG. 4).

While the vehicle 102 is depicted as a particular land vehicle, use of the overpressure absorbing material on other land vehicles (e.g., tanks, trains, civilian cars and trucks, etc.) and other vehicle types (e.g., aircraft, watercraft, spacecraft, etc.) is contemplated herein. In another implementation, the vehicle 102 is an individual person, while the armor 106 is the person's skin and/or body armor.

The overpressure absorbing material is readily deformable in order to absorb the rapidly applied energy from the explosion 108. In one implementation, the shock absorbing panels include one or more arrays of opposed hemispherical or hemi-ellipsoidal hollow cells attached to upper and lower sheets of material, as described in detail with regard to FIGS. 6-8. The arrays of opposed hemispherical or hemi-ellipsoidal hollow cells may resiliently or non-resiliently collapse when impinged upon by the incoming pressure wave 110, as illustrated in FIG. 1. FIG. 1 is not drawn to scale.

Figure 2:
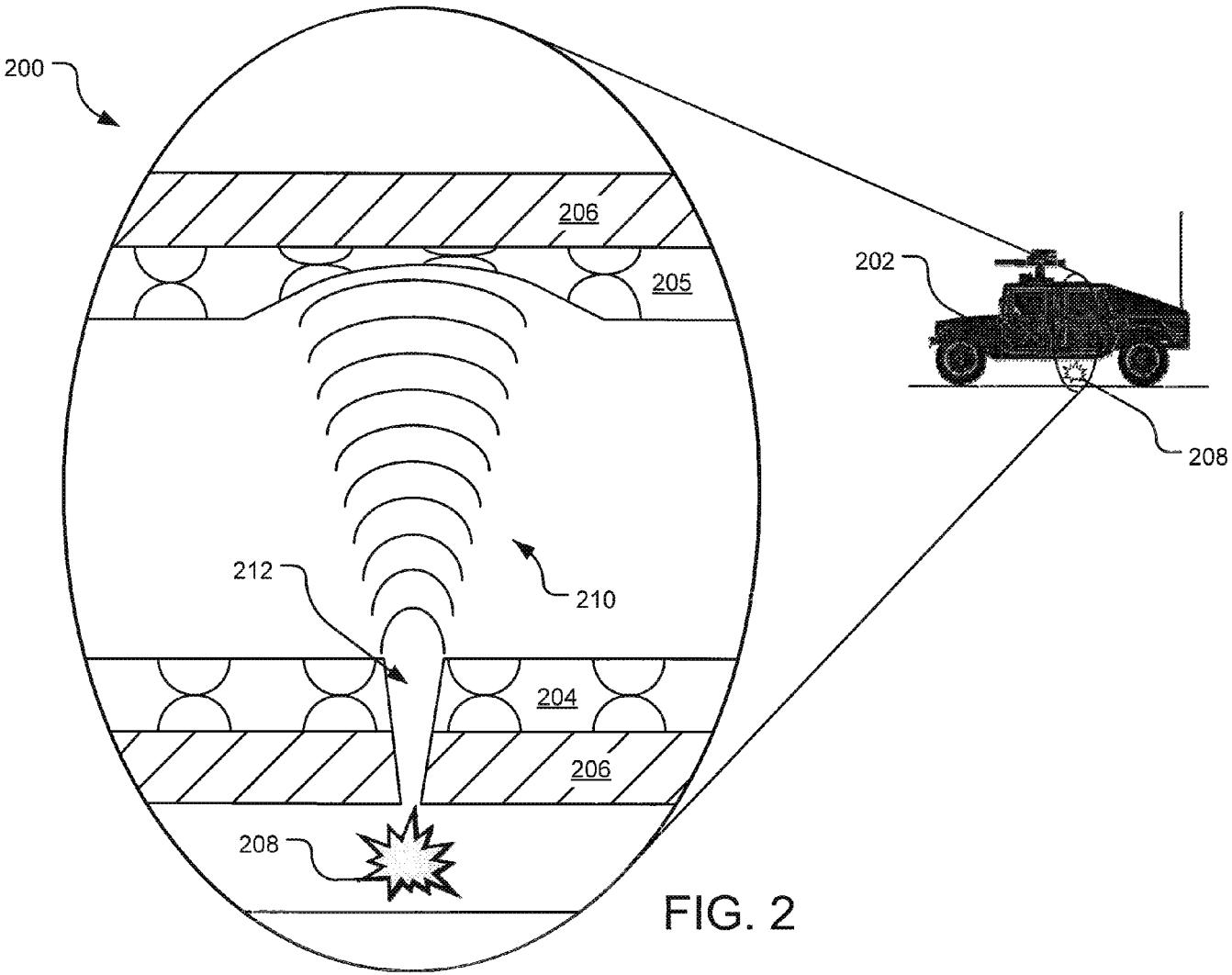
FIG. 2 illustrates an example armored vehicle equipped with interior overpressure absorbing material.

FIG. 2 illustrates an example armored vehicle 202 equipped with interior overpressure absorbing material (e.g., panels 204, 205). The overpressure absorbing material is positioned on the vehicle 202 on the inside of armor 206 or other protective layer. When an explosion 208 occurs adjacent the vehicle 202, the energy of the explosion, including impact of projectiles may breach the vehicle 202 (see breach 212). Further, the vehicle 202 may already be breached by previous damage, or an open door or window. A pressure wave 210 from the explosion 208 enters the vehicle 202 via the breach 212 (or other opening) and may resonate within the vehicle 202, causing injury to the vehicle's occupants. The overpressure absorbing material absorbs a large portion of the pressure wave 210, preventing a significant magnitude of the pressure wave 210 from being reflected off the interior walls of the vehicle 202, resonating within the vehicle 202, and causing injury to the vehicle's occupants, by deforming, absorbing, and dispersing energy from the explosion 208. As a result, reflected pressure waves within the vehicle 202 are absorbed rather than being reinforced. In some implementations, the magnitude of the explosion, especially combined with relatively weak armor 206, may transmit through the armor 206 by deflection of the armor 206 without breach 212 or other opening.

While the vehicle 202 is depicted as a particular land vehicle, use of the overpressure absorbing material on other land vehicles (e.g., tanks, trains, civilian cars and trucks, etc.) and other vehicle types (e.g., aircraft, watercraft, spacecraft, etc.) is contemplated herein. In another implementation, the vehicle 202 is an individual person, while the armor 206 is the person's skin and/or body armor.

Figure 5:
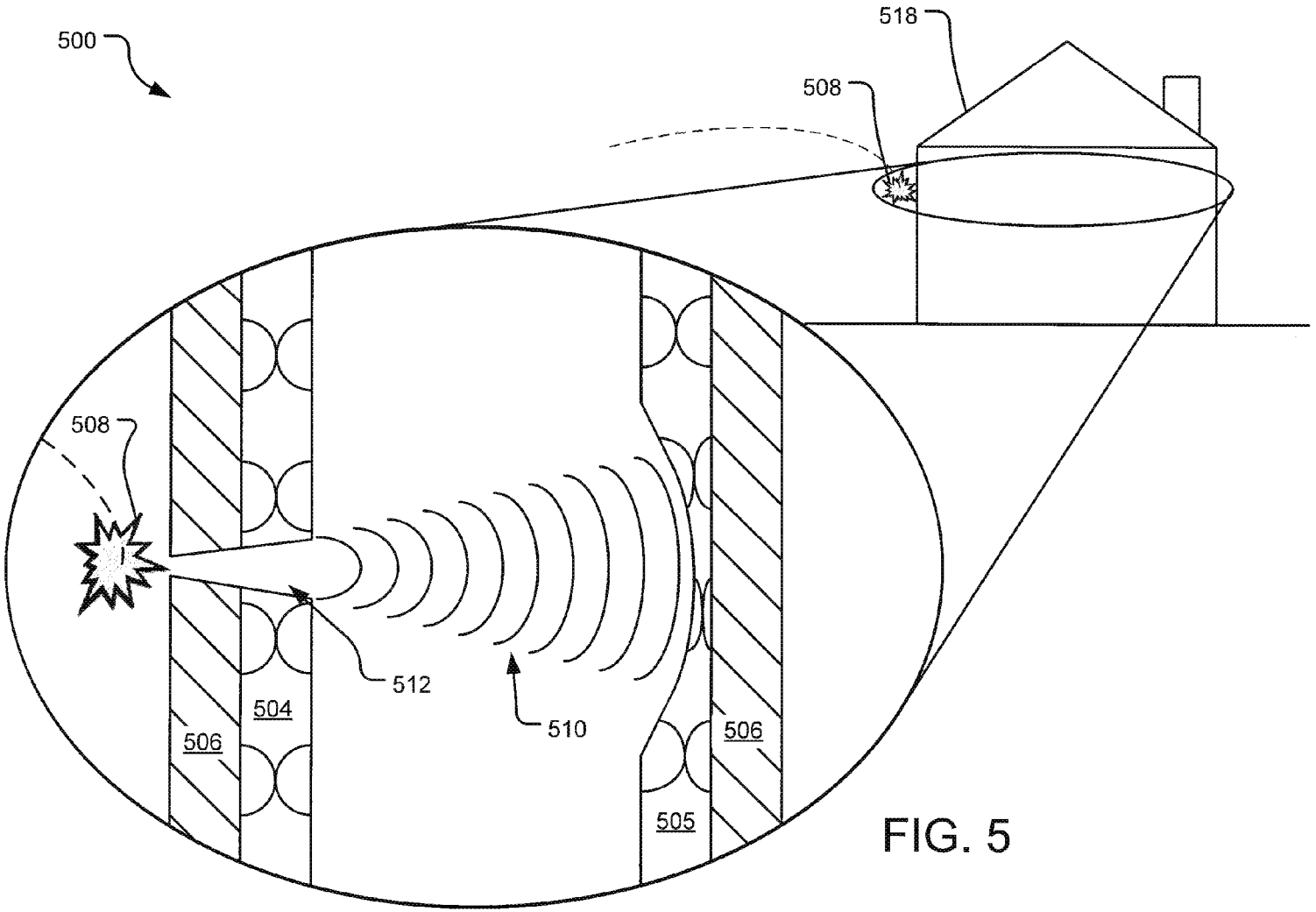
FIG. 5 illustrates an example fixed structure equipped with interior overpressure absorbing material.

A similar combination of armor 206 and panel 204 may be used to protect occupants within a stationary enclosure that is fully or partially sealed and that is at risk of adjacent explosions (see e.g., FIG. 5). Further, the interior overpressure absorbing panels 204, 205 for absorbing pressure waves within the vehicle 202 may be combined with exterior overpressure absorbing panels (see e.g., panel 104 of FIG. 1) for reducing the possibility of a breach into the vehicle 202 and/or reducing pressure wave transmission through the armor 206.

The overpressure absorbing material is readily deformable in order to absorb the rapidly applied energy from the explosion 208. In one implementation, the overpressure absorbing material includes one or more arrays of opposed hemispherical or hemi-ellipsoidal hollow cells attached to upper and lower sheets of material, as described in detail with regard to FIGS. 6-8. The arrays of opposed hemispherical or hemi-ellipsoidal hollow cells may resiliently or non-resiliently collapse when impinged upon by the pressure wave 210, as illustrated in FIG. 2, or one or more reflected pressure waves within the vehicle 202 (not shown). FIG. 2 is not drawn to scale.

Figure 3:
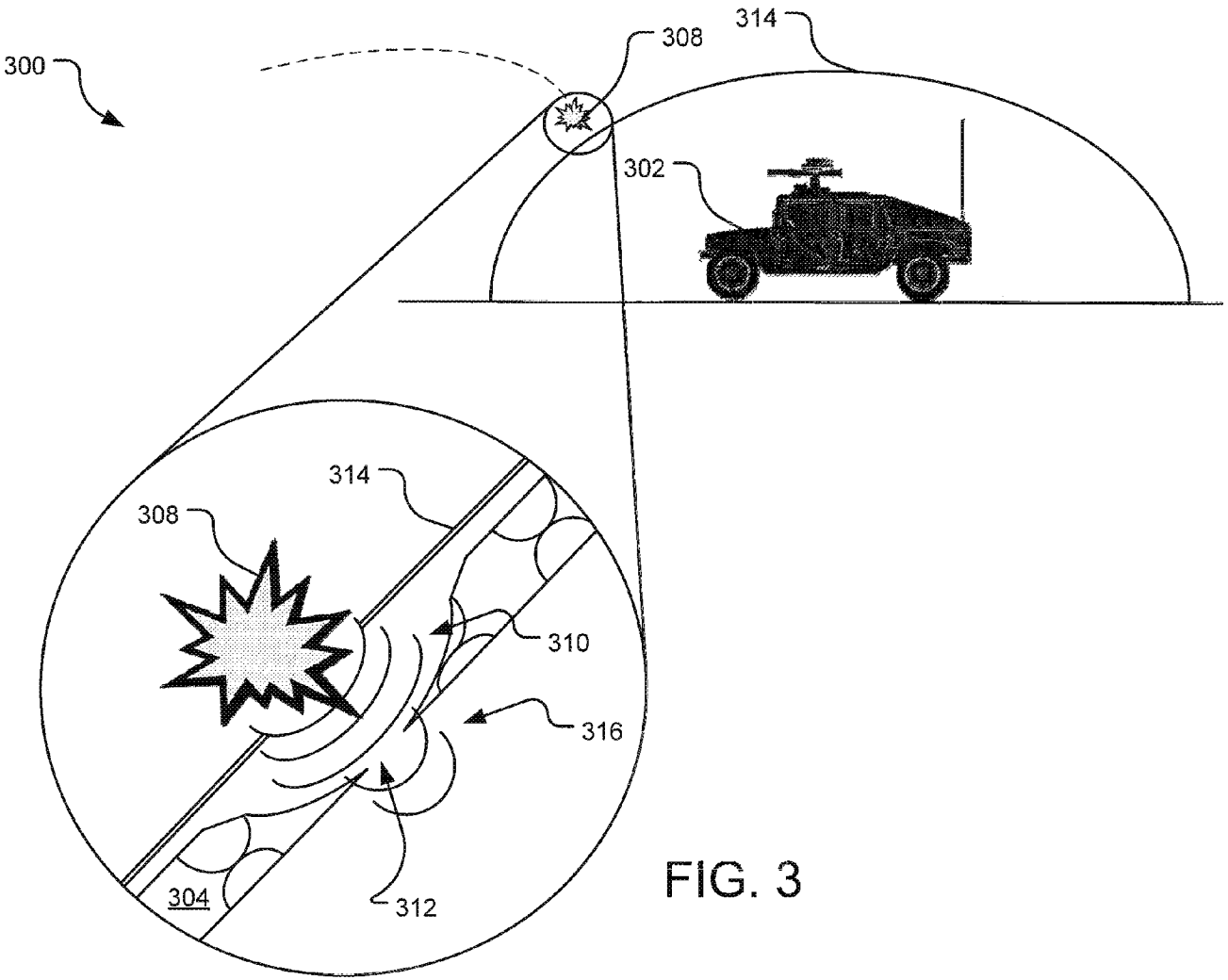
FIG. 3 illustrates an example armored vehicle covered by netting equipped with overpressure absorbing material.

FIG. 3 illustrates an example armored vehicle 302 covered by netting 314 (or tent 314) equipped with overpressure absorbing material 304. The netting 314 or other protective layer surrounds the vehicle 302 a distance away from the vehicle (e.g., 5-10 feet). The netting 314 catches and triggers incoming rocket propelled grenades (RPGs) or other airborne explosives directed at the vehicle 302 prior to impacting the vehicle 302. As a result, explosion 308 occurs a distance away from the vehicle 302 rather than immediately adjacent the vehicle 302. This reduces the potential of damage to the vehicle 302 and/or its occupants caused by shrapnel impacts and/or pressure wave impacts triggered by the explosion 308. In one implementation, the netting 314 takes the form of a tubular or other metal or plastic framework with netting spanning distances between the metal framework. The netting has multiple metallic components within its span that trigger the incoming RPGs or other airborne explosives directed at the vehicle 302 prior to impacting the vehicle 302.

The overpressure absorbing material 304 is applied to the inside of the netting 314. In other implementations, the overpressure absorbing material 304 is applied to the outside of the netting 314. When the explosion 308 occurs, a breach 312 forms in the netting 314 and the overpressure absorbing material 304 absorbs a large portion of an incoming pressure wave 310 from the explosion 308. A pressure wave 316 that continues through the netting 314 is significantly reduced in magnitude from the initial pressure wave 310.

Used in conjunction with the armor on the vehicle 302, the overpressure absorbing material 304 reduces the magnitude of the pressure wave (i.e., moving from pressure wave 310 to pressure wave 316) against the vehicle 302 and may prevent the incoming pressure wave 316 from penetrating the vehicle 302 in sufficient magnitude to cause injury to the vehicle's occupants by deforming, absorbing, and dispersing energy from the explosion 308. A similar combination of netting 314, overpressure absorbing material 304, and/or armor may be used to protect occupants within a stationary enclosure that is at risk of adjacent exterior explosions (see e.g., FIG. 4).

While the vehicle 302 is depicted as a particular land vehicle, use of the overpressure absorbing material on other land vehicles (e.g., tanks, trains, civilian cars and trucks, etc.) and other vehicle types (e.g., aircraft, watercraft, spacecraft, etc.) is contemplated herein. In another implementation, the vehicle 302 is an individual person and the netting 314 or other protective layer surrounds the individual person.

The overpressure absorbing material 304 is readily deformable in order to absorb the rapidly applied energy from the explosion 308. In one implementation, the shock absorbing material 304 includes one or more arrays of opposed hemispherical or hemi-ellipsoidal hollow cells attached to upper and lower sheets of material, as described in detail with regard to FIGS. 6-8. The arrays of opposed hemispherical or hemi-ellipsoidal hollow cells may resiliently or non-resiliently collapse and/or fracture when impinged upon by the incoming pressure wave 310, as illustrated in FIG. 3. FIG. 3 is not drawn to scale.

Figure 4:
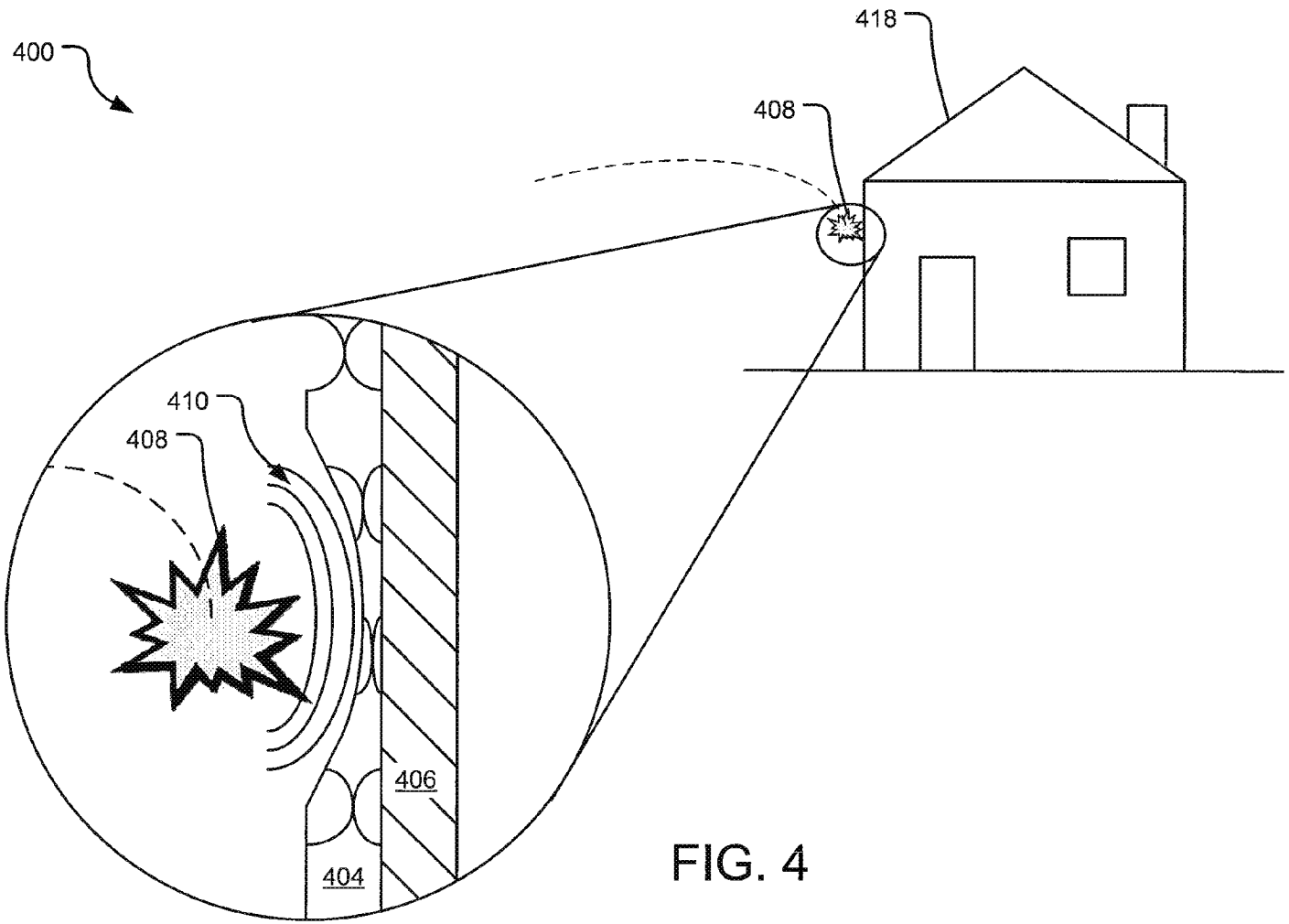
FIG. 4 illustrates an example fixed structure equipped with exterior overpressure absorbing material.

FIG. 4 illustrates an example fixed structure 418 equipped with exterior overpressure absorbing material (e.g., panel 404). The fixed structure 418 may be a home, business, military installation, or other building or series of buildings. The overpressure absorbing material is positioned on the structure 418 on the outside of wall 406 (which could be reinforced (e.g., armored) to protect against incoming projectiles or explosions) or other protective layer. When an incoming RPG or other airborne explosive directed at the structure 418 causes an explosion 408 adjacent the exterior of the structure 418, the overpressure absorbing material absorbs a large portion of an incoming pressure wave 410 from the explosion 408. Used in conjunction with the wall 406, the overpressure absorbing material cushions the impact of the pressure wave 410 against the structure 418 and may prevent the incoming pressure wave 410 from penetrating the structure 418 in sufficient magnitude to cause injury to the structure's occupants by deforming, absorbing, and dispersing energy from the explosion 408. A similar combination of wall 406 and panel 404 may be used to protect occupants within a mobile enclosure (e.g., a vehicle) that is at risk of adjacent exterior explosions (see e.g., FIG. 1).

The overpressure absorbing material is readily deformable in order to absorb the rapidly applied energy from the explosion 408. In one implementation, the shock absorbing panels include one or more arrays of opposed hemispherical or hemi-ellipsoidal hollow cells attached to upper and lower sheets of material, as described in detail with regard to FIGS. 6 8. The arrays of opposed hemispherical or hemi-ellipsoidal hollow cells may resiliently or non-resiliently collapse when impinged upon by the incoming pressure wave 410, as illustrated in FIG. 4. FIG. 4 is not drawn to scale.

FIG. 5 illustrates an example fixed structure 518 equipped with interior overpressure absorbing material (e.g., panels 504, 505). The fixed structure 518 may be a home, business, military installation, or other building or series of buildings. The overpressure absorbing material is positioned on the fixed structure 518 on the inside of walls 506 (which could be reinforced (e.g., armored) to protect against incoming projectiles or explosions) or other protective layers. When an incoming RPG or other airborne explosive directed at the structure 518 causes an explosion 508 adjacent the structure 518, the energy of the explosion, including impact of projectiles may breach the structure 518 (see breach 512). Further, the structure 518 may already be breached by previous damage, or an open door or window.

A pressure wave 510 from the explosion 508 enters the structure 518 via the breach 512 (or other opening) and may resonate within the structure 518, causing injury to the structure's occupants. The overpressure absorbing material absorbs a large portion of the pressure wave 510, preventing a significant magnitude of the pressure wave 510 from being reflected off the interior walls of the structure 518, resonating within the structure 518, and causing injury to the structure's occupants, by deforming, absorbing, and dispersing energy from the explosion 508. As a result, reflected pressure waves within the structure 518 are absorbed rather than being reinforced. In some implementations, the magnitude of the explosion, especially combined with relatively weak walls 506, may transmit through the walls 506 by deflection of the walls 506 without breach 512 or other opening.

A similar combination of walls 506 and panels 504, 505 may be used to protect occupants within a mobile enclosure (e.g., a vehicle) that is fully or partially sealed and that is at risk of adjacent explosions (see e.g., FIG. 2). Further, the interior overpressure absorbing panels 504, 505 for absorbing pressure waves within the structure 518 may be combined with exterior overpressure absorbing panels (see e.g., panel 404 of FIG. 4) for reducing the possibility of a breach into the structure 518 and/or reducing pressure wave transmission through the walls 506.

The overpressure absorbing material is readily deformable in order to absorb the rapidly applied energy from the explosion 508. In one implementation, the overpressure absorbing material includes one or more arrays of opposed hemispherical or hemi-ellipsoidal hollow cells attached to upper and lower sheets of material, as described in detail with regard to FIGS. 6-8. The arrays of opposed hemispherical or hemi-ellipsoidal hollow cells may resiliently or non-resiliently collapse when impinged upon by the pressure wave 510, as illustrated in FIG. 5, or one or more reflected pressure waves within the vehicle 502 (not shown). FIG. 5 is not drawn to scale.

Figure 6:
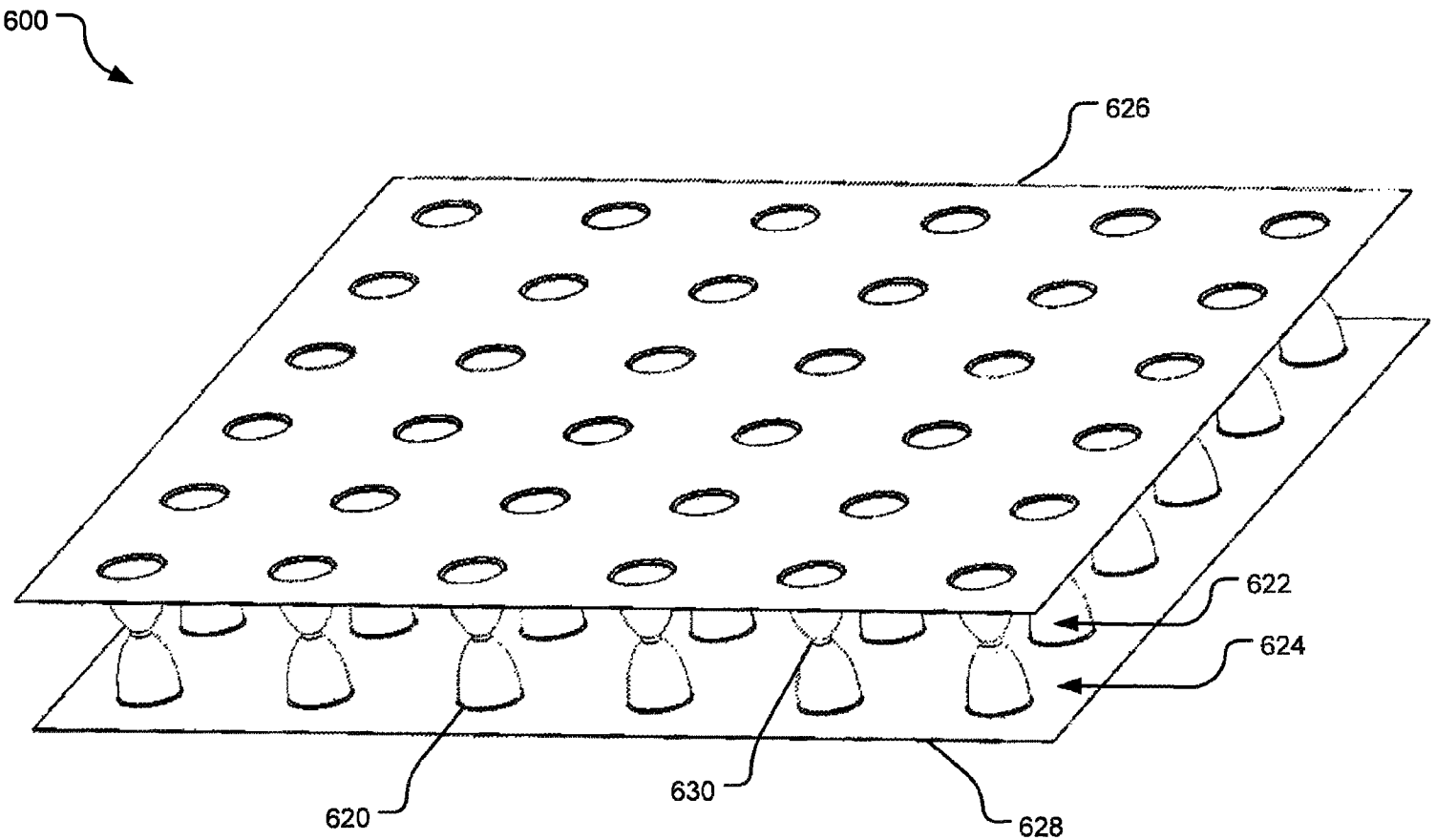
FIG. 6 illustrates an isometric view of an example overpressure absorbing panel.

FIG. 6 illustrates an isometric view of an example overpressure absorbing panel 600. The shock absorbing panel 600 includes protrusions (e.g., protrusion 620) or support units arranged in a top matrix 622 (or array) and a bottom matrix 624 (or array). The protrusions are hollow and resist deflection due to compressive forces, similar to compression springs. The top matrix 622 protrudes from an upper material sheet 626 and the bottom matrix 624 protrudes from a lower material sheet 628. Opposing protrusions in each of the top matrix 622 and the bottom matrix 624 meet with and are fixedly attached to one another (e.g., via welds, such as weld 630). In one implementation, the surface area of each of the upper material sheet 626 and the lower material sheet 628 is at least fifty percent planar (as distinct from recessed to form the individual protrusions).

Figure 7:
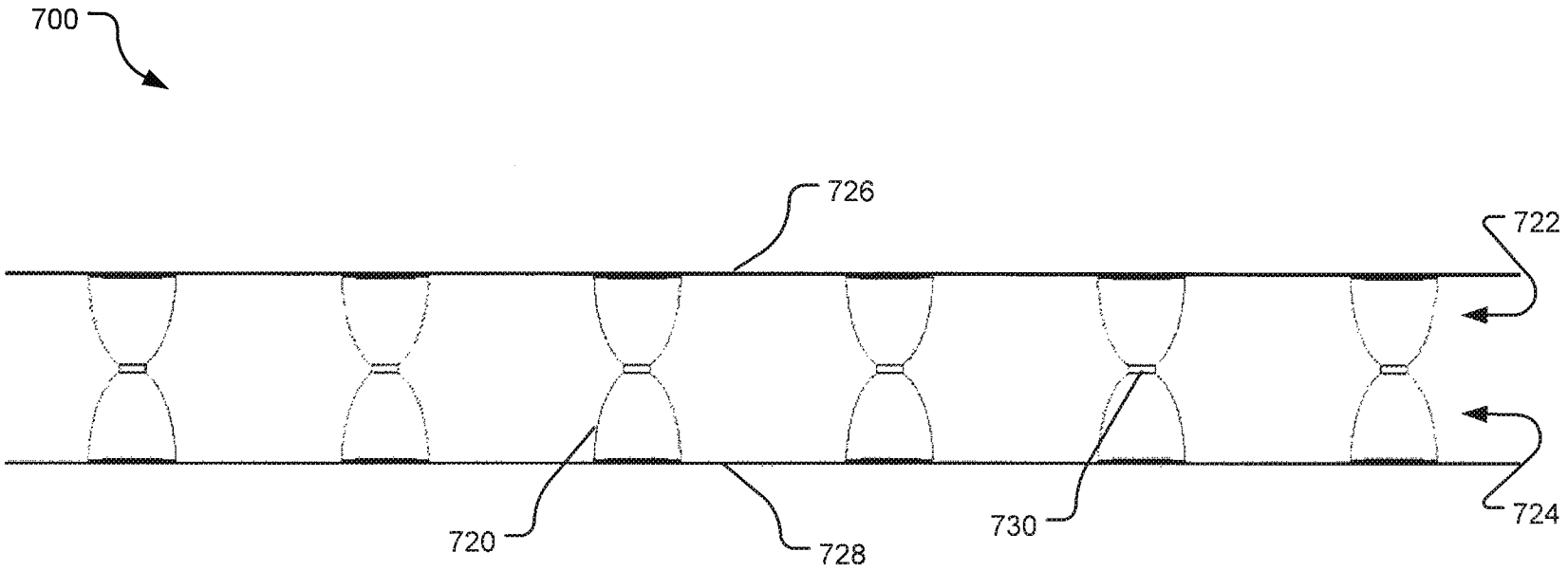
FIG. 7 illustrates an elevation view of an example overpressure absorbing panel.

FIG. 7 illustrates an elevation view of an example overpressure absorbing panel 700. The shock absorbing panel 700 includes protrusions (e.g., protrusion 720) or support units arranged in a top matrix 722 (or array) and a bottom matrix 724 (or array). The protrusions are hollow and resist deflection due to compressive forces, similar to compression springs. The top matrix 722 protrudes from an upper material sheet 726 and the bottom matrix 724 protrudes from a lower material sheet 728. Opposing protrusions in each of the top matrix 722 and the bottom matrix 724 meet with and are fixedly attached to one another (e.g., via welds, such as weld 730). In one implementation, the surface area of each of the upper material sheet 726 and the lower material sheet 728 is at least fifty percent planar (as distinct from recessed to form the individual protrusions).

Figure 8:
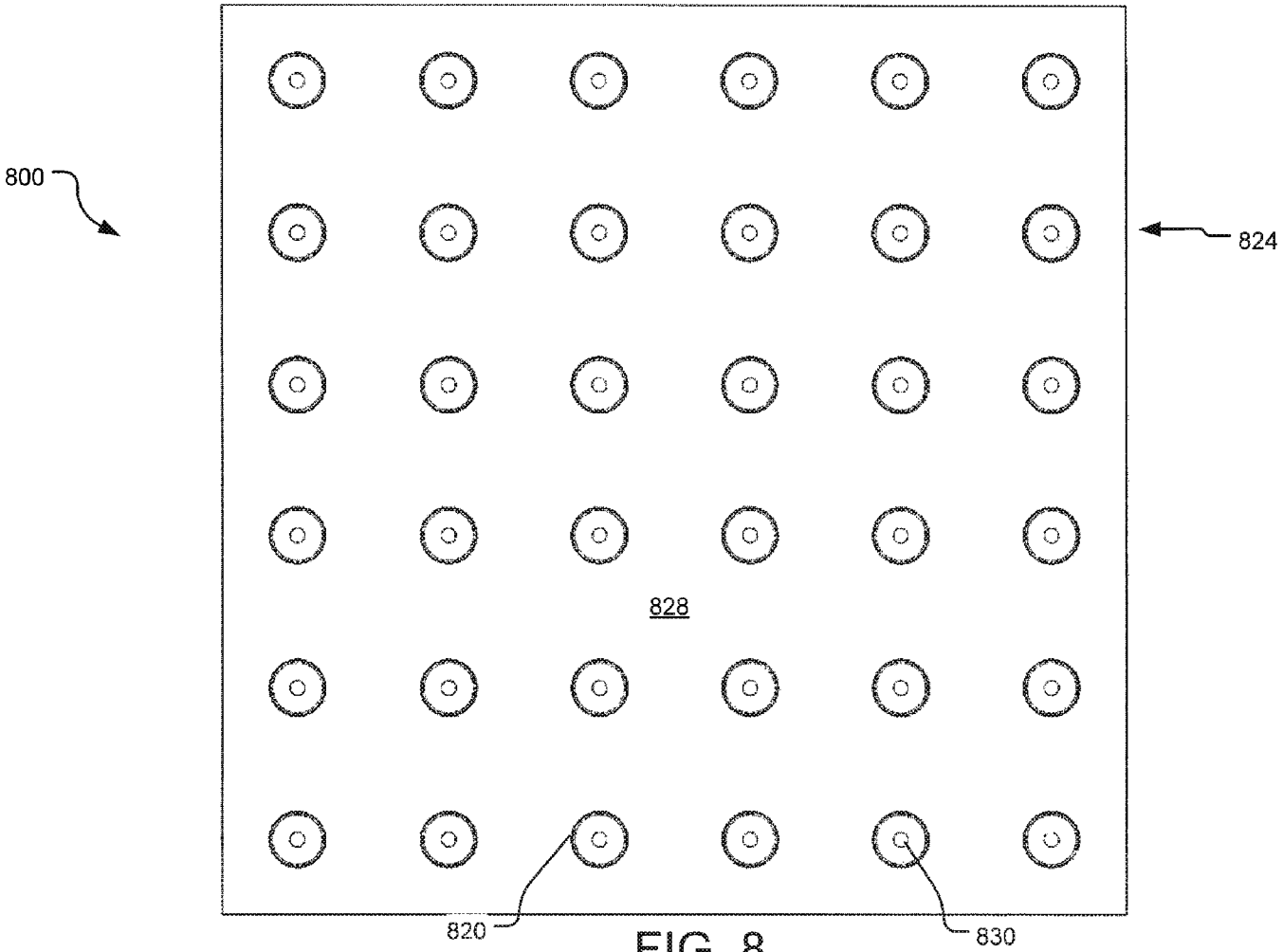
FIG. 8 illustrates a plan view of an example overpressure absorbing panel.

FIG. 8 illustrates a plan view of an example overpressure absorbing panel 800. The shock absorbing panel 800 includes protrusions (e.g., protrusion 820) or support units arranged in a top matrix (or array) (not shown) and a bottom matrix 824 (or array). The protrusions are hollow and resist deflection due to compressive forces, similar to compression springs. The top matrix protrudes from an upper material sheet (not shown) and the bottom matrix 824 protrudes from a lower material sheet 828. Opposing protrusions in each of the top matrix and the bottom matrix 824 meet with and are fixedly attached to one another (e.g., via welds, such as weld 830). In one implementation, the surface area of each of the upper material sheet and the lower material sheet 828 is at least fifty percent planar (as distinct from recessed to form the individual protrusions).

The following specifications apply to at least the example overpressure absorbing panels 600, 700, 800 of FIGS. 6-8. At least the material, wall thickness, size, and shape of each of the protrusions defines the resistive force each of the protrusions can apply. In one implementation, materials used for the overpressure absorbing panels may be generally elastically deformable under expected load conditions and will withstand numerous deformations without fracturing or suffering other breakdown impairing the function of the overpressure absorbing panels. In other implementations, the materials used for the overpressure absorbing panels are non-elastically deformable and may fracture or otherwise fail after an explosion. There materials may be replaced after an explosion.

Example materials for the overpressure absorbing panels include thermoplastic urethane, thermoplastic elastomers, styrenic co-polymers, rubber, Dow Pellethane®, Lubrizol Estane®, Dupont™, Hytrel®, ATOFINA Pebax®, and Krayton polymers. Further, the wall thickness of each protrusions may range from 5 mil to 10 mil. Still further, the size of each of the protrusions may range from 0.25 to 1.5 inches in diameter and 0.5 to 3.0 inches in height in a hemi-ellipsoidal implementation. Further yet, the protrusions may be cubical, pyramidal, hemispherical, hemi-ellipsoidal, or any other shape capable of having a hollow interior volume. Other shapes may have similar dimensions as the aforementioned hemi-ellipsoidal implementation. Still further, the protrusions may be spaced a variety of distances from one another. An example spacing range is 0.5 to 3.0 inches.

The overpressure absorbing panels may be manufactured using a variety of manufacturing processes (e.g., blow molding, thermoforming, extrusion, injection molding, laminating, etc.). In one implementation, the overpressure absorbing panels are manufactured in two halves, a first half comprises an upper material sheet with corresponding protrusions. The second half comprises the lower material sheet with corresponding protrusions. Individual protrusions of each of the two halves of the overpressure absorbing panels are then laminated, glued, or otherwise attached together. In another implementation, the overpressure absorbing panels are manufactured in one piece rather than two pieces as discussed above. The overpressure absorbing material may come in the form of flat or molded panels that are applied to surfaces of a vehicle, structure, or human body. The overpressure absorbing material may also come in a roll that is unrolled over a vehicle, structure, or human body. The overpressure absorbing material may also be flexible enough to conform to contours in a vehicle, structure, or human body.

Further, an overpressure absorbing panel according to the presently disclosed technology may include more than two matrices of protrusions stacked on top of one another (e.g., two or more overpressure absorbing panels stacked on top of one another). Still further, an overpressure absorbing panel according to the presently disclosed technology may include only one matrix of protrusions.

Figure 9:
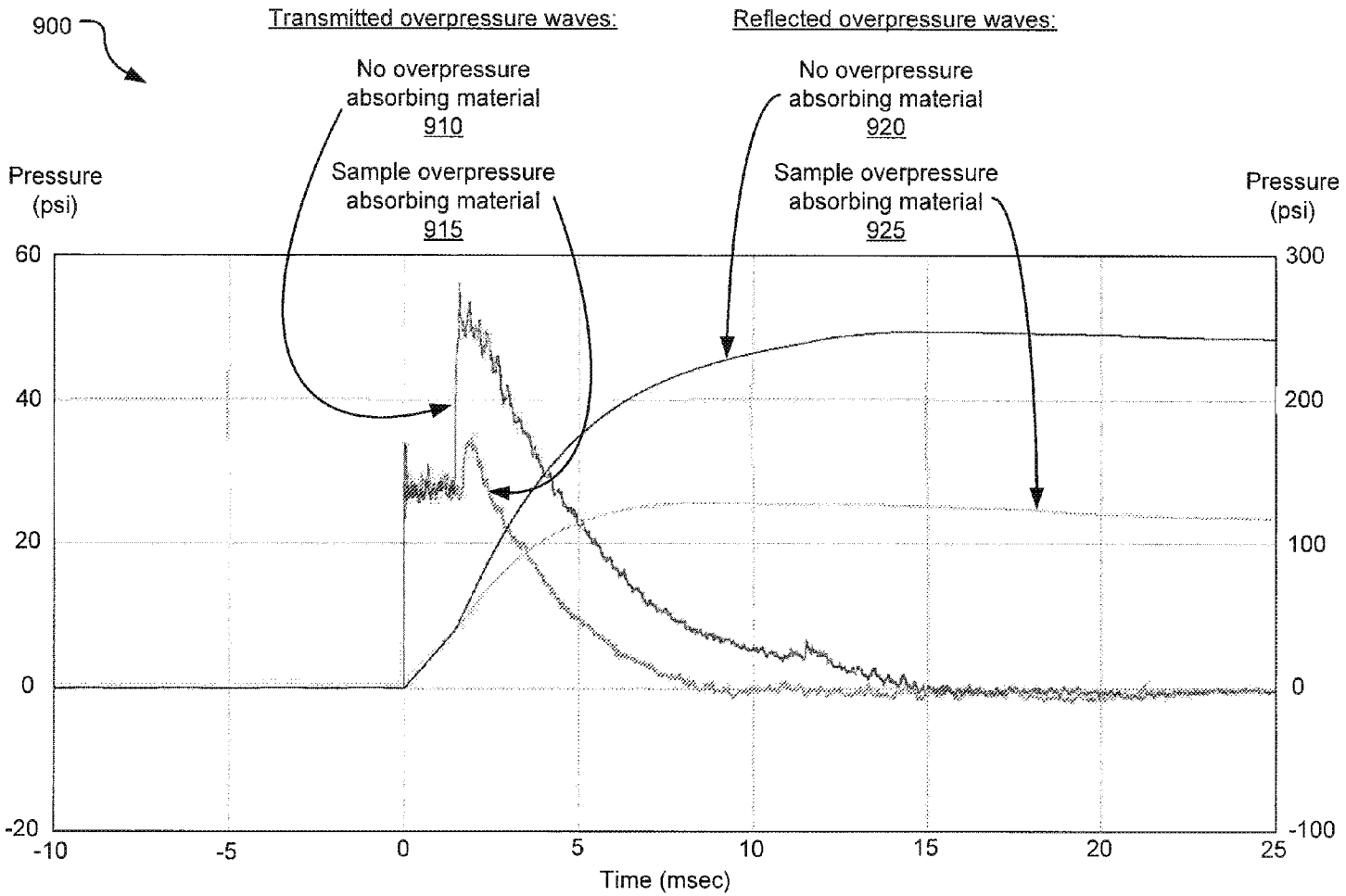
FIG. 9 is a graph illustrating the effect of overpressure absorbing material on both pressure waves transmitted through the pressure absorbing material and pressure waves transmitted reflected from the pressure absorbing material.

FIG. 9 is a graph 900 illustrating the effect of overpressure absorbing material on both pressure waves transmitted through the pressure absorbing material and pressure waves transmitted reflected from the pressure absorbing material. The data of graph 900 was obtained using a test chamber that rapidly releases a pressure wave toward a bare metal panel in implementations illustrated by lines 910, 920 and a metal panel lined with overpressure absorbing material illustrated by lines 915, 925.

Line 910 is a measurement of the pressure transmitted through the bare metal panel in line with the test chamber (i.e., a shock tube). Line 915 is a measurement of the pressure transmitted through the same metal panel, but after having passed through overpressure absorbing material. Line 910 shows a peak transmitted pressure of approximately 55 psi. Line 915 shows a peak transmitted pressure of approximately 35 psi. As a result, the overpressure absorbing material reduces transmitted pressure waves through the metal panel by approximately 36%.

In an implementation where the panel covered with the overpressure absorbing material is properly interposed between an explosive blast and an individual, the results would be as if the blast were moved farther away since the overpressure absorbing material absorbs a substantial portion of the overpressure wave front from the main blast.

Line 920 is a measurement of the pressure reflected from the bare metal panel in line with the test chamber (i.e., a shock tube). Line 915 is a measurement of the pressure reflected from the same metal panel, but after having passed through overpressure absorbing material. In this implementations, the measurement is taken eight inches from the metal panel. Line 920 shows a peak reflected pressure of approximately 250 psi. Line 925 shows a peak reflected pressure of approximately 125 psi. As a result, the overpressure absorbing material reduces reflected pressure waves from the metal panel by approximately 50%.

In an implementation where the panel covered with the overpressure absorbing material may substantially reduce or eliminate the amplifying effect of being subjected to both primary and secondary pressure waves within an enclosure. In one implementation, the overpressure absorbing material would reduce the effects of the overpressure to be as an individual within an enclosure was instead in open air.

Figure 10:
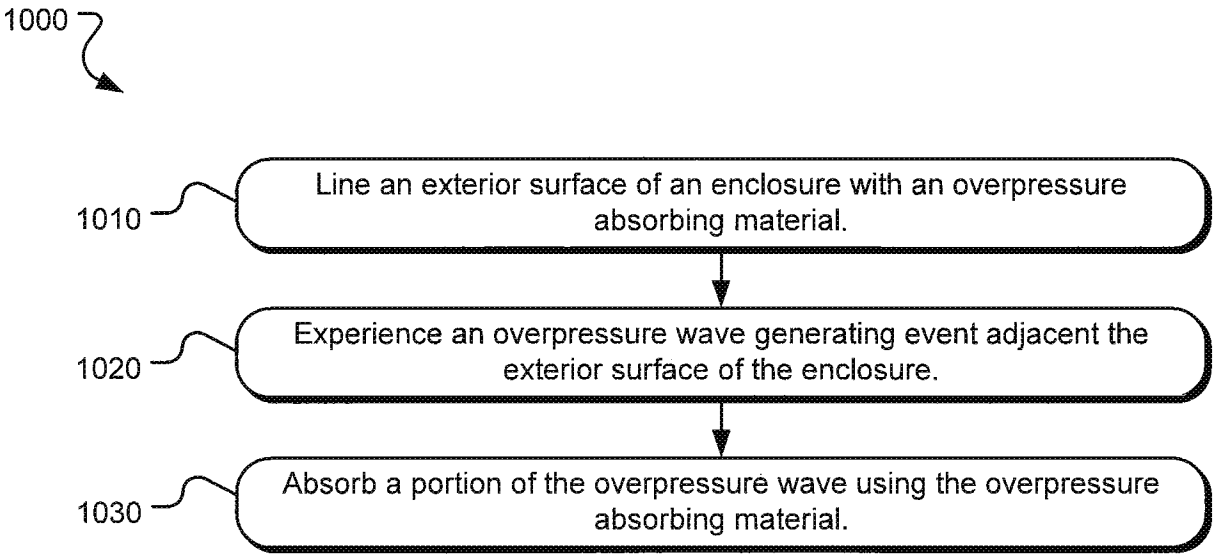
FIG. 10 illustrates example operations for using overpressure absorbing material on an exterior surface of an enclosure.

FIG. 10 illustrates example operations 1000 for using overpressure absorbing material on an exterior surface of an enclosure. The exterior surface of the enclosure may be referred to herein as a protective layer. A lining operation 1010 lines an exterior surface of an enclosure with an overpressure absorbing material. The enclosure may be a stationary structure (e.g., a home, business, or military installation) or a mobile structure (e.g., a land vehicle, watercraft, aircraft, etc.). The enclosure may be armored to further protect occupants of the enclosure from injury. In various implementations, all exposed exterior surfaces are lined with the overpressure absorbing material. In other implementations, only exterior surfaces most at risk are lined (e.g., the floorboard of an armored vehicle). The overpressure absorbing material may be placed between the exterior surface and an expected source of an overpressure wave. In one implementation, the enclosure is an individual's body and the protective layer is the individual's skin and/or body armor.

In an experiencing operation 1020, the enclosure experiences an overpressure wave generating event adjacent the exterior surface of the enclosure. In some implementations, an explosive device (e.g., an improvised explosive device (IED), RPG, mine, missile, bomb, etc.) impacts the exterior surface of the enclosure and explodes. In other implementations, the explosive device explodes in close proximity to, but not contact with the exterior surface of the enclosure. For example, countermeasures (e.g., a RPG screen, Phalanx close-in weapon system (CIWS), etc.) may cause the explosive device to explode prior to contacting the exterior surface of the enclosure, thus reducing (but not necessarily eliminating) the pressure wave incident on the exterior surface of the enclosure.

An absorbing operation 1030 absorbs a portion of the overpressure wave using the overpressure absorbing material. The overpressure absorbing material deflects from the overpressure wave, distributing and absorbing energy from the overpressure wave. As a result, lighter armor may be used with the overpressure absorbing material as compared to armor without overpressure absorbing material. In some implementations, the overpressure absorbing material is resilient and may withstand multiple explosions. In other implementations, the overpressure absorbing material permanently deforms and is replaced after every explosion for maximum effectiveness.

Figure 11:
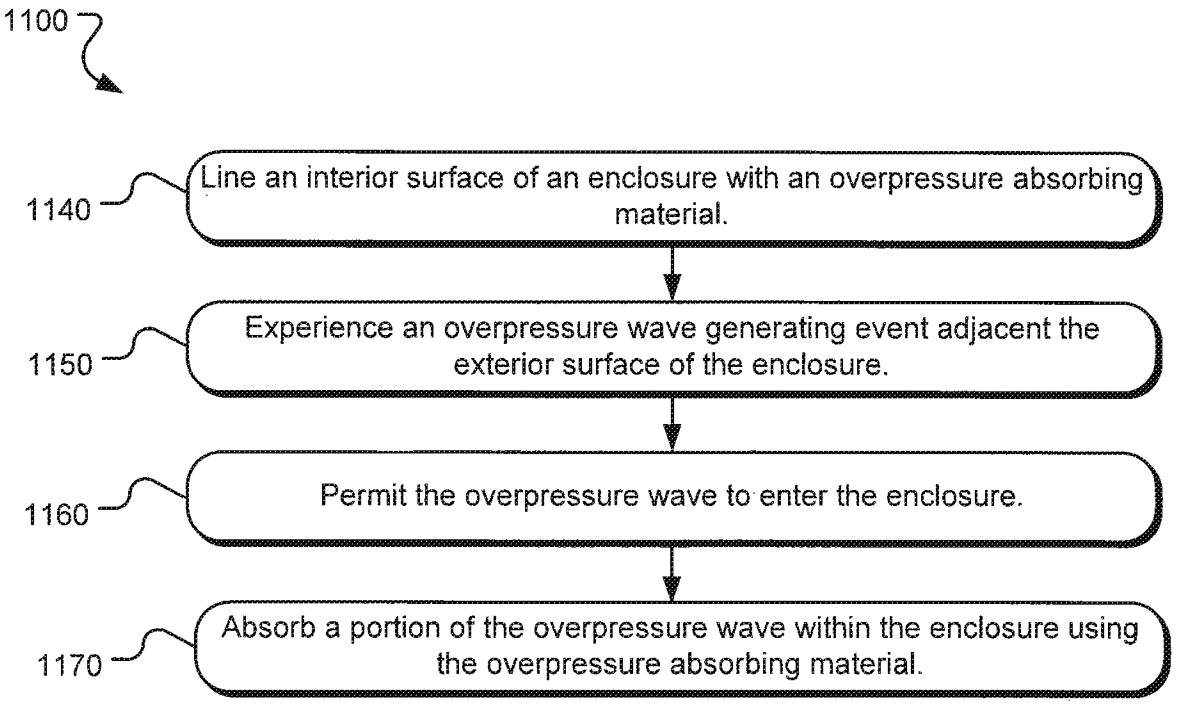
FIG. 11 illustrates example operations for using overpressure absorbing material on an interior surface of an enclosure.

FIG. 11 illustrates example operations 1100 for using overpressure absorbing material on an interior surface of an enclosure. The exterior surface of the enclosure may be referred to herein as a protective layer. A lining operation 1140 lines an interior surface of an enclosure with an overpressure absorbing material. The enclosure may be stationary (e.g., a home, business, or military installation) or mobile (e.g., a land vehicle, watercraft, aircraft, etc.). The enclosure may be armored to further protect occupants of the enclosure from injury. In various implementations, all interior surfaces are lined with the overpressure absorbing material. In other implementations, only exposed interior surfaces and interior surfaces near occupants of the enclosure are lined. The more interior surfaces that are lined, the more effective the overpressure absorbing material is at absorbing overpressure waves being reflected and resonating within the enclosure. The overpressure absorbing material may be placed between the interior surface and an expected source of an overpressure wave within the enclosure.

In an experiencing operation 1150, the enclosure experiences an overpressure wave generating event adjacent the exterior surface of the enclosure. In some implementations, an explosive device (e.g., an IED, RPG, mine, missile, bomb, etc.) impacts the exterior surface of the enclosure and explodes. In other implementations, the explosive device explodes in close proximity to, but not contact with the exterior surface of the enclosure. For example, countermeasures (e.g., a RPG screen, Phalanx CIWS, etc.) may cause the explosive device to explode prior to contacting the exterior surface of the enclosure, thus reducing (but not necessarily eliminating) the pressure wave incident on the exterior surface of the enclosure.

A permitting operation 1160 permits the overpressure wave to enter the enclosure. Permitting operation 1160 may occur due to a breach in the exterior surface caused by impact of one or more projectiles. Further, a window and/or door of the enclosure may be open, providing a path for the overpressure wave to enter the enclosure. An absorbing operation 1170 absorbs a portion of the overpressure wave within the enclosure using the overpressure absorbing material. The overpressure absorbing material absorbs energy from the primary and/or secondary reflected overpressure waves, distributing and absorbing energy from the overpressure wave. As a result, reflections, if any, of the overpressure wave within the enclosure are substantially reduced. In some implementations, the overpressure absorbing material is resilient and may withstand multiple explosions. In other implementations, the overpressure absorbing material permanently deforms and is replaced after every explosion for maximum effectiveness.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. An overpressure wave absorbing system comprising:

a protective layer;

a first deflectable planar layer with a first matrix of deflectable protrusions formed therein and a second deflectable planar layer with a second matrix of deflectable protrusions formed therein wherein the first deflectable planar layer and the second deflectable planar layer each have substantially greater than fifty percent planar surface area, wherein at least one deflectable protrusion of the second matrix of deflectable protrusions is attached to an opposing deflectable protrusion of the first matrix of deflectable protrusions, and wherein one or both of the first deflectable planar layer with the first matrix of deflectable protrusions and the second deflectable planar layer with the second matrix of deflectable protrusions are configured to absorb a portion of an incoming overpressure wave and reduce a magnitude of the overpressure wave incident on the protective layer.

2. The overpressure wave absorbing system of claim 1, wherein the protective layer is attached to the first deflectable planar layer.

3. The overpressure wave absorbing system of claim 1, wherein the protective layer is offset a distance from the first deflectable planar layer.

4. The overpressure wave absorbing system of claim 1, wherein the magnitude of the overpressure wave incident on the protective layer is reduced by at least twenty percent.

5. The overpressure wave absorbing system of claim 1, wherein the protective layer is armor on an armored vehicle.

6. The overpressure wave absorbing system of claim 1, wherein the protective layer is body armor on an individual.

7. The overpressure wave absorbing system of claim 1, wherein the protective layer is wall of a fixed structure.

8. The overpressure wave absorbing system of claim 1, wherein the protective layer is an individual's skin.

9. The overpressure wave absorbing system of claim 1, configured to absorb energy by deflecting in response to the overpressure wave.

10. The overpressure wave absorbing system of claim 1, wherein the deflectable protrusions extending from the first deflectable planar layer have a height to diameter ratio of greater than about 1:1.

11. The overpressure wave absorbing system of claim 1, wherein the deflectable protrusions extending from the first deflectable planar layer have a height to diameter ratio of greater than about 2:1.

12. The overpressure wave absorbing system of claim 1, wherein the protective layer is a wall of a partially-sealed enclosure.

13. A method of absorbing an overpressure wave comprising:

placing a first deflectable planar layer with a first matrix of deflectable protrusions formed therein between a protective layer and an expected source of an incoming overpressure wave, and placing a second deflectable planar layer with a second matrix of deflectable protrusions formed therein adjacent the first deflectable planar layer with the first matrix of deflectable protrusions, wherein the first deflectable planar layer and the second deflectable planar layer each have substantially greater than fifty percent planar surface area, wherein at least one deflectable protrusion of the second matrix of deflectable protrusions is attached to an opposing deflectable protrusion of the first matrix of deflectable protrusions, and wherein one or both of the first deflectable planar layer with a the first matrix of deflectable protrusions and the second deflectable planar layer with the second matrix of deflectable protrusions are is configured to absorb a portion of the incoming overpressure wave and reduce a magnitude of the overpressure wave incident on the protective layer.

14. The method of claim 13, wherein the protective layer is attached to the first deflectable planar layer.

15. The method of claim 13, wherein the protective layer is offset a distance from the first deflectable planar layer.

16. The method of claim 13, wherein the magnitude of the overpressure wave incident on the protective layer is reduced by at least twenty percent.

17. The method of claim 13, wherein the protective layer is armor on an armored vehicle.

18. The method of claim 13, wherein the protective layer is body armor on an individual.

19. The method of claim 13, wherein the protective layer is wall of a fixed structure.

20. The method of claim 13, wherein the protective layer is an individual's skin.

21. The method of claim 13, configured to absorb energy by deflecting in response to the overpressure wave.

22. The method of claim 13, wherein the deflectable protrusions extending from the first deflectable planar layer have a height to diameter ratio of greater than about 1:1.

23. The method of claim 13, wherein the deflectable protrusions extending from the first deflectable planar layer have a height to diameter ratio of greater than about 2:1.

24. An overpressure wave absorbing system comprising:

a protective layer;

a first deflectable planar layer with a first matrix of deflectable protrusions formed therein; and a second deflectable planar layer with a second matrix of deflectable protrusions formed therein, wherein the first deflectable planar layer and the second deflectable planar layer each have has substantially greater than fifty percent planar surface area, wherein at least one deflectable protrusion of the second matrix of deflectable protrusions is attached to an opposing deflectable protrusion of the first matrix of deflectable protrusions, and wherein one or both of the first deflectable planar layer with the first matrix of deflectable protrusions and the second deflectable planar layer with the second matrix of deflectable protrusions are configured to absorb a portion of an incoming overpressure wave and reduce a magnitude of the overpressure wave reflected from the protective layer.

25. The overpressure wave absorbing system of claim 24, wherein the protective layer is attached to the first deflectable planar layer.

26. The overpressure wave absorbing system of claim 24, wherein the protective layer is offset a distance from the first deflectable planar layer.

27. The overpressure wave absorbing system of claim 24, wherein the magnitude of the overpressure wave reflected from the protective layer is reduced by at least forty percent.

28. The overpressure wave absorbing system of claim 24, wherein the protective layer is armor on an armored vehicle.

29. The overpressure wave absorbing system of claim 24, wherein the protective layer is body armor on an individual.

30. The overpressure wave absorbing system of claim 24, wherein the protective layer is wall of a fixed structure.

31. The overpressure wave absorbing system of claim 24, wherein the protective layer is an individual's skin.

32. The overpressure wave absorbing system of claim 24, configured to absorb energy by deflecting in response to the overpressure wave.

33. The overpressure wave absorbing system of claim 24, wherein the deflectable protrusions extending from the first deflectable planar layer have a height to diameter ratio of greater than about 1:1.

34. The overpressure wave absorbing system of claim 24, wherein the deflectable protrusions extending from the first deflectable planar layer have a height to diameter ratio of greater than about 2:1.

35. A method of absorbing an overpressure wave comprising:

placing a first deflectable planar layer with a first matrix of deflectable protrusions formed therein between a protective layer and an expected source of an incoming overpressure wave, and placing a second deflectable planar layer with a second matrix of deflectable protrusions formed therein adjacent the first deflectable planar layer with the first matrix of deflectable protrusions, wherein the first deflectable planar layer and the second deflectable planar layer each have substantially greater than fifty percent planar surface area, wherein at least one deflectable protrusion of the second matrix of deflectable protrusions is attached to an opposing deflectable protrusion of the first matrix of deflectable protrusions, and wherein one or both of the first deflectable planar layer with a the first matrix of deflectable protrusions and the second deflectable planar layer with the second matrix of deflectable protrusions are is configured to absorb a portion of the incoming overpressure wave and reduce a magnitude of the overpressure wave reflected from the protective layer.

36. The method of claim 35, wherein the protective layer is attached to the first deflectable planar layer.

37. The method of claim 35, wherein the protective layer is offset a distance from the first deflectable planar layer.

38. The method of claim 35, wherein the magnitude of the overpressure wave reflected from the protective layer is reduced by at least forty percent.

39. The method of claim 35, wherein the protective layer is armor on an armored vehicle.

40. The method of claim 35, wherein the protective layer is body armor on an individual.

41. The method of claim 35, wherein the protective layer is wall of a fixed structure.

42. The method of claim 35, wherein the protective layer is an individual's skin.

43. The method of claim 35, configured to absorb energy by deflecting in response to the overpressure wave.

44. The method of claim 35, wherein the deflectable protrusions extending from the first deflectable planar layer have a height to diameter ratio of greater than about 1:1.

45. The method of claim 35, wherein the deflectable protrusions extending from the first deflectable planar layer have a height to diameter ratio of greater than about 2:1.

* * * * *